US006283652B1

(12) United States Patent
Sasaki et al.

(10) Patent No.: US 6,283,652 B1
(45) Date of Patent: Sep. 4, 2001

(54) HOLLOW DRUM-TYPE RECORDING APPARATUS

(75) Inventors: Yoshiharu Sasaki; Mitsuru Sawano, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/536,144

(22) Filed: Mar. 28, 2000

(30) Foreign Application Priority Data

Mar. 29, 1999 (JP) ..... 11-086401

(51) Int. Cl.[7] ..... B41J 35/28

(52) U.S. Cl. ..... 400/208; 400/224.2; 400/242; 400/246

(58) Field of Search ..... 400/208.1, 208, 400/207, 224.2, 242, 246; 347/262

(56) References Cited

U.S. PATENT DOCUMENTS 1,024,157 * 4/1912 Steele .
3,623,586 * 11/1971 Sellabarger ..... 197/175
5,162,815 * 11/1992 Hodge ..... 346/76 PH
6,204,871 * 3/2001 Keller et al. ..... 347/139

* cited by examiner

*Primary Examiner*—John S. Hilten
*Assistant Examiner*—Kevin D. Williams
(74) *Attorney, Agent, or Firm*—Sughrue, Mion, Zinn, Macpeak & Seas, PLLC

(57) ABSTRACT

A hollow drum-type recording apparatus includes: a hollow drum which has an opening and whose hollow circular arc-shaped main body rotates; a recording sheet which is wound around the surface of the circular arc-shaped main body of the hollow drum from a recording sheet roll; an internal holder for a feed roll and an internal holder for a take-up roll for respectively accommodating and disposing inside the hollow drum a feed roll for feeding a toner sheet and a take-up roll for taking up the toner sheet through the opening; and an external holder for a feed roll and an external holder for a take-up roll for respectively accommodating and disposing outside the hollow drum the feed roll for feeding the toner sheet and the take-up roll for taking up the toner sheet through the opening, wherein the winding, releasing, and discharging of the toner sheet are effected by appropriately moving the feed roll and the take-up roll between the internal holders and the external holders and by rotating the hollow drum.

16 Claims, 10 Drawing Sheets

HOLLOW DRUM-TYPE RECORDING APPARATUS

BACKGROUND OF THE INVENTION

1. Field of the Invention

The present invention relates to an image recording apparatus for transferring an image from a toner sheet onto an image-receiving sheet or a final sheet (hereinafter referred to as the recording sheet).

2. Description of the Related Art

A conventional color-image recording apparatus based on the transfer process is arranged such that, in a case where, for example, color printing in four colors including yellow (Y), magenta (M), cyan (C), and black (B) is effected, a recording sheet is wound around and fixed on a hollow drum, exposure is effected with a toner sheet of the first color (Y color) superposed thereon to transfer the Y color onto the recording sheet, and the toner sheet is released. A toner sheet of the second color (M color) is then superposed on the recording sheet to transfer the M color onto the recording sheet, and the toner sheet is released. Similarly, exposure and transfer of the C color and the B color are consecutively effected, thereby forming a four-color print.

With the above-described recording apparatus, however, there has been a problem in that since the transfer and releasing are repeated four times on the hollow drum in the case of color printing in the four colors of Y, M, C, and B, the apparatus becomes large, and it is therefore impossible to meet recent demands to make electronic equipment compact and other similar demands.

SUMMARY OF THE INVENTION

Accordingly, it is an object of the present invention to provide a hollow drum-type recording apparatus whose overall size is made compact by accomodating the toner sheet inside the hollow drum and whose printing operation is made efficient.

To this end, in accordance with a first aspect of the present invention, there is provided a hollow drum-type recording apparatus comprising: a hollow drum which has an opening and whose hollow circular arc-shaped main body rotates; an internal holder for a feed roll and an internal holder for a take-up roll for respectively accommodating and disposing inside the hollow drum a feed roll for feeding a toner sheet and a take-up roll for taking up the toner sheet through the opening; and an external holder for a feed roll and an external holder for a take-up roll for respectively accommodating and disposing outside the hollow drum the feed roll for feeding the toner sheet and the take-up roll for taking up the toner sheet through the opening, wherein the winding, releasing, and discharging of the toner sheet are effected by appropriately moving the feed roll and the take-up roll between the internal holders and the external holders and by rotating the hollow drum.

In accordance with the above-described configuration, the apparatus is made compact by accommodating the toner sheet inside the hollow drum, and the winding, releasing, and discharging operations are made possible by the combined operation of the movement of the feed roll or the take-up roll for feeding or taking up the toner sheet between the position of the internal holder inside the hollow drum and the position of the external holder outside the hollow drum as well as the rotation of the hollow drum.

In accordance with a second aspect of the present invention, the hollow drum-type recording apparatus according to the first aspect of the invention further comprises: toner-sheet loading means for transferring and loading the feed roll and the take-up roll between the internal holders and the external holders.

In accordance with this aspect of the invention, since the feed roll and the take-up roll can be automatically transferred between the inner side and the outer side of the hollow drum without a manual operation, the automation of the apparatus becomes possible.

Further, in accordance with a third aspect of the present invention, in the hollow drum-type recording apparatus according to the second aspect of the invention, the toner-sheet loading means effects a series of operations of transferring the feed roll to the external holder, bringing the feed roll into contact with the hollow drum at a position for winding the toner sheet, locking the rotation of the take-up roll, winding the toner sheet around a recording sheet on the hollow drum by rotating the hollow drum, and subsequently returning the feed roll back to the internal holder.

In accordance with this aspect of the invention, the toner sheet can be wound around and set on the recording sheet fixed on the surface of the hollow drum, by the movement of the feed roll to outside the hollow drum and the rotation of the hollow drum.

Further, in accordance with a fourth aspect of the present invention, in the hollow drum-type recording apparatus according to the third aspect of the invention, the toner-sheet loading means effects a series of operations of transferring the feed roll to the external holder, locking the rotation of the take-up roll, releasing the toner sheet by rotating the hollow drum and bringing the feed roll into contact with the hollow drum, and subsequently returning the feed roll back to the internal holder.

In accordance with this aspect of the invention, the toner sheet can be released by transferring the feed roll to outside the hollow drum and by rotating the hollow drum.

Further, in accordance with a fifth aspect of the present invention, in the hollow drum-type recording apparatus according to the second aspect of the invention, the toner-sheet loading means effects a series of operations of transferring the take-up roll to the external holder outside the hollow drum, bringing the take-up roll into contact with the hollow drum at a position for winding the toner sheet, locking the rotation of the feed roll, winding the toner sheet around a recording sheet on the follow drum by rotating the hollow drum, and subsequently returning the take-up roll back to the internal holder.

In accordance with this aspect of the invention, the toner sheet can be also wound around and set on the recording sheet fixed on the surface of the hollow drum, by moving the take-up roll to outside the hollow drum.

Further, in accordance with a sixth aspect of the present invention, in the hollow drum-type recording apparatus according to the fifth aspect of the invention, the toner-sheet loading means effects a series of operations of transferring the take-up roll to the external holder, locking the rotation of the feed roll, releasing the toner sheet by rotating the hollow drum and bringing the take-up roll into contact with the hollow drum, and subsequently returning the take-up roll back to the internal holder.

In accordance with this aspect of the invention, the toner sheet can be released by moving the take-up roll to outside the hollow drum.

Further, in accordance with a seventh aspect of the present invention, in the hollow drum-type recording apparatus according to any one of the third to sixth aspects of the invention, instead of causing the feed roll or the take-up roll to contact and press the hollow drum, a squeegeeing/releasing means is provided to effect pressing and releasing.

In accordance with this aspect of the invention, since its own squeegeeing/releasing means is provided, creases are made difficult to occur.

In accordance with an eighth aspect of the invention, the squeegeeing/releasing means is a squeegeeing/releasing roller.

In accordance with this aspect of the invention, since the squeegeeing/releasing means can be rotated with accompanied with a rotation of the hollow drum at the time when the recording media is rolled up on a surface of the hollow drum or the time when the recording media is rotated on a surface of the hollow drum, friction is prevented from being developed. Therefor recording media is not damaged and an image defect can be prevented from being caused by a scratch in the output image.

In accordance with a ninth aspect of the present invention, the squeegeeing/releasing means has a crown shape of surface.

In accordance with this aspect of the invention, since a force is applied to the roller uniformly in a whole width direction, a strain of the recording media is made difficult to occur. Additionally, creases are also made difficult to occur. wherein said squeegeeing/releasing roller has a zebra pattern on the surface of the roller.

In accordance with a tenth aspect of the present invention, said squeegeeing/releasing means has a zebra pattern on a surface thereof.

In accordance with this aspect, since a force is applied from a center to both ends in an axis direction according to a presence of the zebra pattern, even if a strain is generated at the time when the recording media is rolled up, the strain is moved to both ends and released at both ends. Therefore, creases are made difficult to occur.

In accordance with an eleventh aspect of the invention, the squeegeeing/releasing means is a squeegeeing/releasing bar.

In accordance with this aspect of the invention, since the curvature of the releasing curved portion can be made large at the time of releasing (i.e., the radius can be made small), the releasing force can be made large.

Further, in accordance with a twelfth aspect of the present invention, the hollow drum-type recording apparatus according to the first or second aspect of the invention further comprises: recording-sheet loading means for sucking a leading end of a recording sheet at a position for starting winding the recording sheet around the hollow drum, rotating the hollow drum, cutting the recording sheet to a predetermined length, and winding the recording sheet around the hollow drum.

In accordance with this aspect of the invention, since the recording sheet can be automatically transferred onto the hollow drum without a manual operation, the automation of the apparatus becomes possible.

Further, in accordance with the thirteenth aspect of the present invention, in the hollow drum-type recording apparatus according to the first aspect of the invention, the loading means effects winding, releasing, and discharging by transferring the take-up roll between the internal holder and the external holder.

In accordance with this aspect of the invention, the winding, releasing, and discharging are made possible easier by transferring the take-up roll from inside the hollow drum to outside the hollow drum and by rotating the hollow drum.

Further, in accordance with a fourteenth aspect of the present invention, in the hollow drum-type recording apparatus according to the first aspect of the invention, exposure recording is effected by an optical head in a state in which a recording sheet and the toner sheet are arranged on a surface of the hollow drum, and both the feed roll and the take-up roll are disposed on the internal holders.

In accordance with this aspect of the invention, since recording can be effected in the state in which a ribbon mechanism is accommodated in the hollow drum, the apparatus can be made compact.

Further, in accordance with a fifteenth aspect of the present invention, the hollow drum-type recording apparatus according to the first aspect of the invention further comprises: an automatic balancer provided in the hollow drum to smoothen the rotation of the hollow drum during recording.

In accordance with this aspect of the invention, since the automatic balancer maintains a rotational balance when a predetermined amount of the toner sheet has moved from the feed roll to the take-up roll, the automatic balancer can be moved from an original position so as to control this unbalance. Therefore it is possible to suppress vibrations and the like during high-speed rotation.

Further, in accordance with a sixteenth aspect of the present invention, in the hollow drum-type recording apparatus according to the first aspect of the invention, said hollow drum has a vacuum means for sucking said recording sheet.

In accordance with this aspect of the present invention, by using the sucking means, a fastener means for fixing the recording sheet is not required. It can be prevented that the fastener means protruded out of the recording sheet causes to be floated up from the recording sheet, be damaged of be broken.

As described above, in accordance with the present invention, the arrangement provided is such that the take-up roll and the feed roll for taking up or feeding the toner sheet are accommodated in the hollow drum, recording is effected with the take-up roll and the feed roll accommodated inside the hollow drum, the feed roll (or the take-up roll) is movable between the internal holder inside the hollow drum and the external holder outside the hollow drum, and the winding, releasing, and discharging are effected by moving the feed roll to outside the hollow drum and rotating the hollow drum. Accordingly, since the toner sheet mechanism is accommodated inside the hollow drum, and an efficiently operating mechanism is made possible, a substantially compact recording apparatus can be realized.

The above and other objects, features and advantages of the present invention will become more apparent from the following detailed description of the invention when read in conjunction with the accompanying drawings.

DESCRIPTION OF THE PREFERRED EMBODIMENTS

Referring now to FIGS. 1 to 7(*g*), a description will be given of a first embodiment of the present invention.

Figure 1:
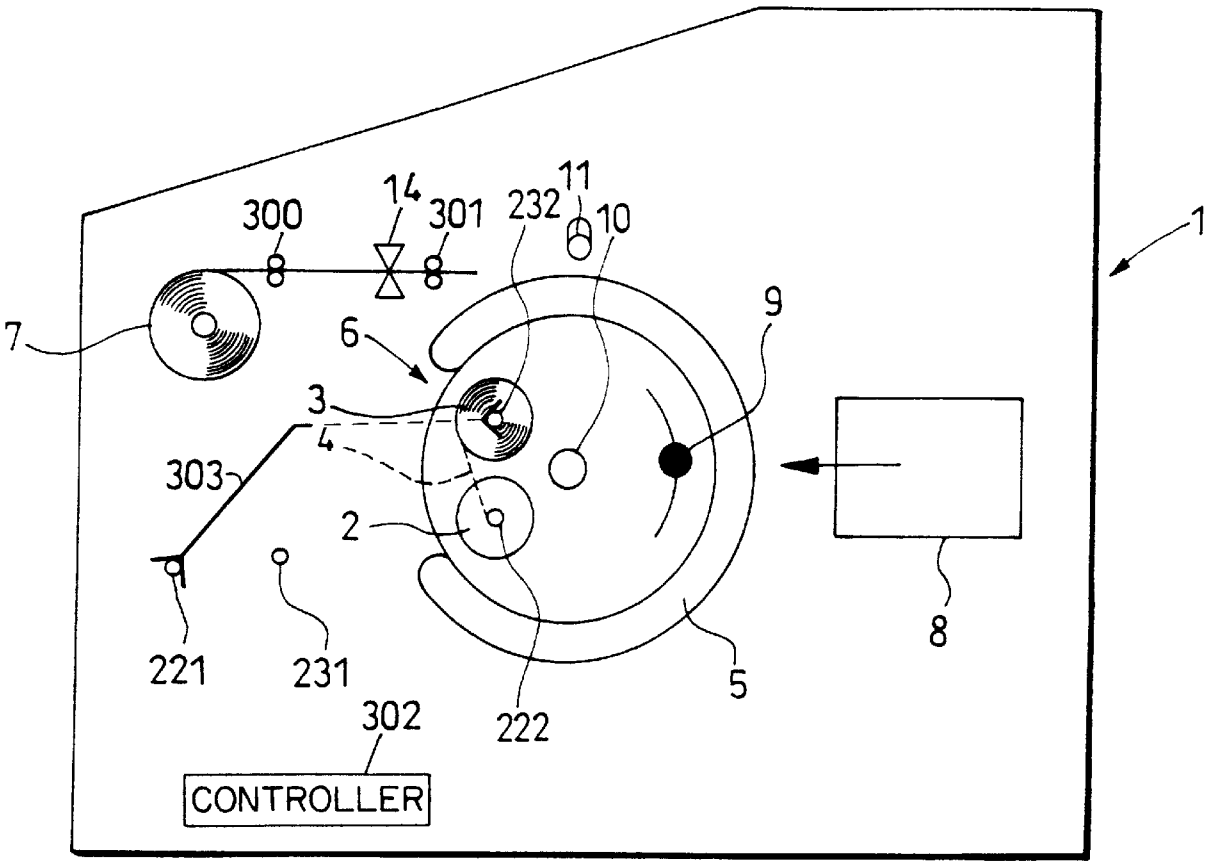
FIG. 1 is a schematic diagram of a hollow drum-type recording apparatus in accordance with a first embodiment of the present invention.

In FIG. 1, reference numeral 1 denotes a hollow drum-type recording apparatus for effecting printing by using a toner sheet on which four colors of B, M, C, and Y are coated in cross stripes (coated alternately on the toner sheet in the order of, for example, B, M, C, and Y). Reference numeral 2 denotes a take-up roll for taking up the toner sheet, while numeral 3 denotes a feed roll with the toner sheet wound therearound, and the take-up roll 2 and the feed roll 3 constitute toner sheet rolls. Numeral 4 denotes a toner sheet on which the four colors of B, M, C, and Y are coated on one side thereof in cross stripes. Numeral 5 denotes a circular arc-shaped hollow drum body, and numeral 6 denotes an opening portion of the hollow drum body, and serves as a passage through which the feed roll 3 or the take-up roll 2 pass.

As shown, an external holder 221 for the take-up roll and an external holder 231 for the feed roll are disposed outside the circular arc-shaped hollow drum 5 for respectively accommodating and fixing the take-up roll 2 and the feed roll 3. The take-up roll 2 and the feed roll 3 are moveable between them by a toner-sheet loading means 302, 303 as illustrated in FIG. 1.

In addition, a plurality of holes which communicate with an inner closed space of the hollow drum 5 are formed in an obverse surface of the hollow drum 5, and as the hollow drum 5 is evacuated by any unillustrated blower, a recording sheet and the toner sheet placed on the obverse surface of the hollow drum 5 are brought into close contact wit the hollow drum 5. Alternatively, it is possible to use a closely contacting means based on electrostatic close contact or the like. Numeral 7 denotes the recording sheet onto which an image is transferred. This recording sheet can be wound around the hollow drum 5 after being cut to a predetermined length by a recording-sheet loading means as illustrated in FIG. 1. The recording sheet loading means is comprised of feed rollers 300, 301, cutter 14, squeegee roller 11 and controller 302. The recording sheet loading means has the function of cutting the recording sheet to be a predetermined length and rolling in onto the hollow drum 5. Numeral 8 denotes an optical head for effecting exposure. Numeral 9 denotes a balancer for the hollow drum 5 for making adjustments such that since the hollow drum 5 becomes unbalanced about its rotating shaft when the toner sheet 4 moves from the feed roll 3 to the take-up roll 2, the high-speed rotation of the hollow drum 5 during recording becomes smooth through the movement of the balancer 9. Numeral 10 denotes a rotating center shaft of the hollow drum 5.

Next, a description will be given of a setting procedure for setting the take-up roll 2 and the feed roll 3 inside the hollow drum 5.

Figure 2:
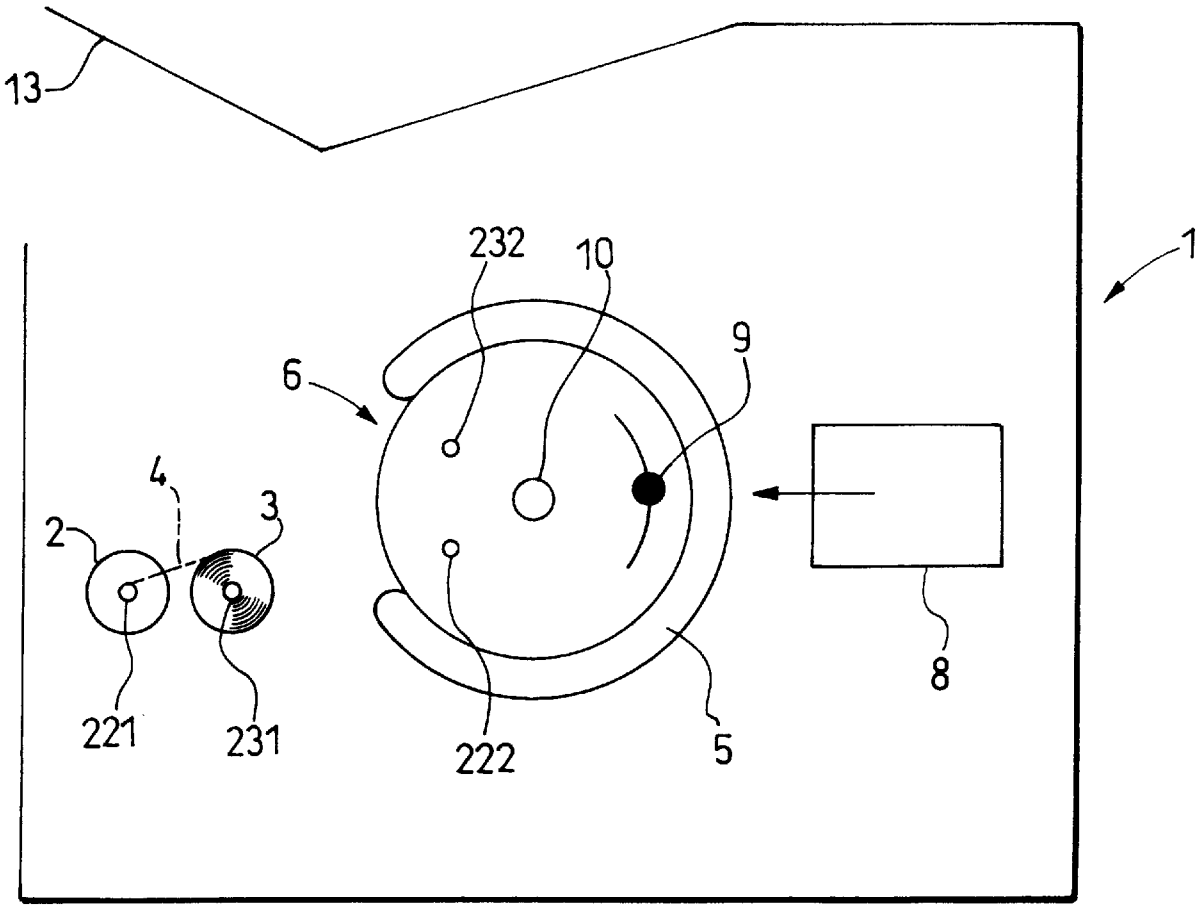
FIG. 2 is a diagram illustrating a first procedure of setting a toner sheet roll shown in FIG. 1.
Figure 3:
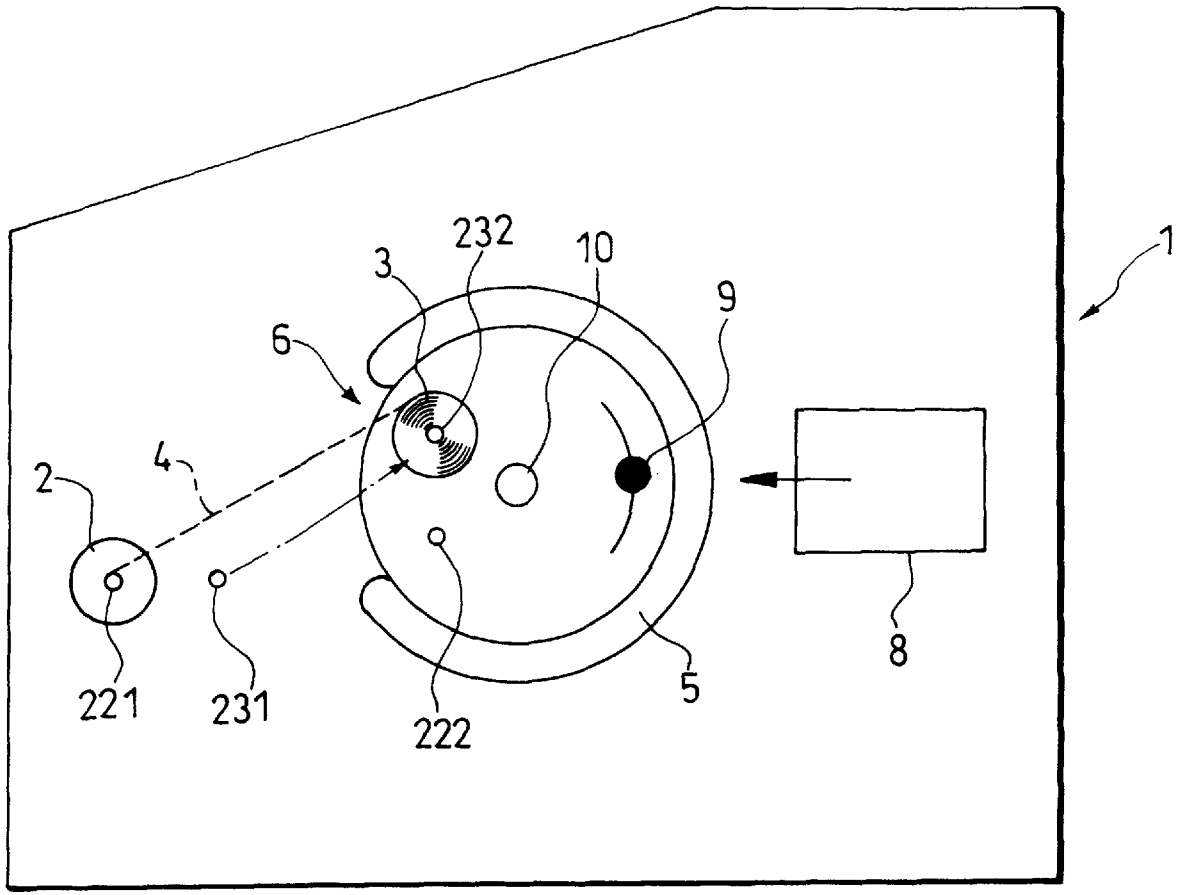
FIG. 3 is a diagram illustrating a second procedure of setting the toner sheet roll shown in FIG. 1.

(1) First, to set the take-up roll 2 and the feed roll 3, as shown in FIG. 2, an opening/closing door 13 of the recording apparatus is opened, and the take-up roll 2 and the feed roll 3 are manually set on the respective external holders 221 and 231 outside the hollow drum 5.

In addition, an unillustrated toner-sheet loading means is disposed on axially opposite sides of the hollow drum 5, and has the function of transporting the take-up roll 2 or the feed roll 3 from the external holder 221 or 231 to the internal holder 222 or 232 and setting it therein while griping the shaft of the take-up roll 2 or the feed roll 3.

Figure 4:
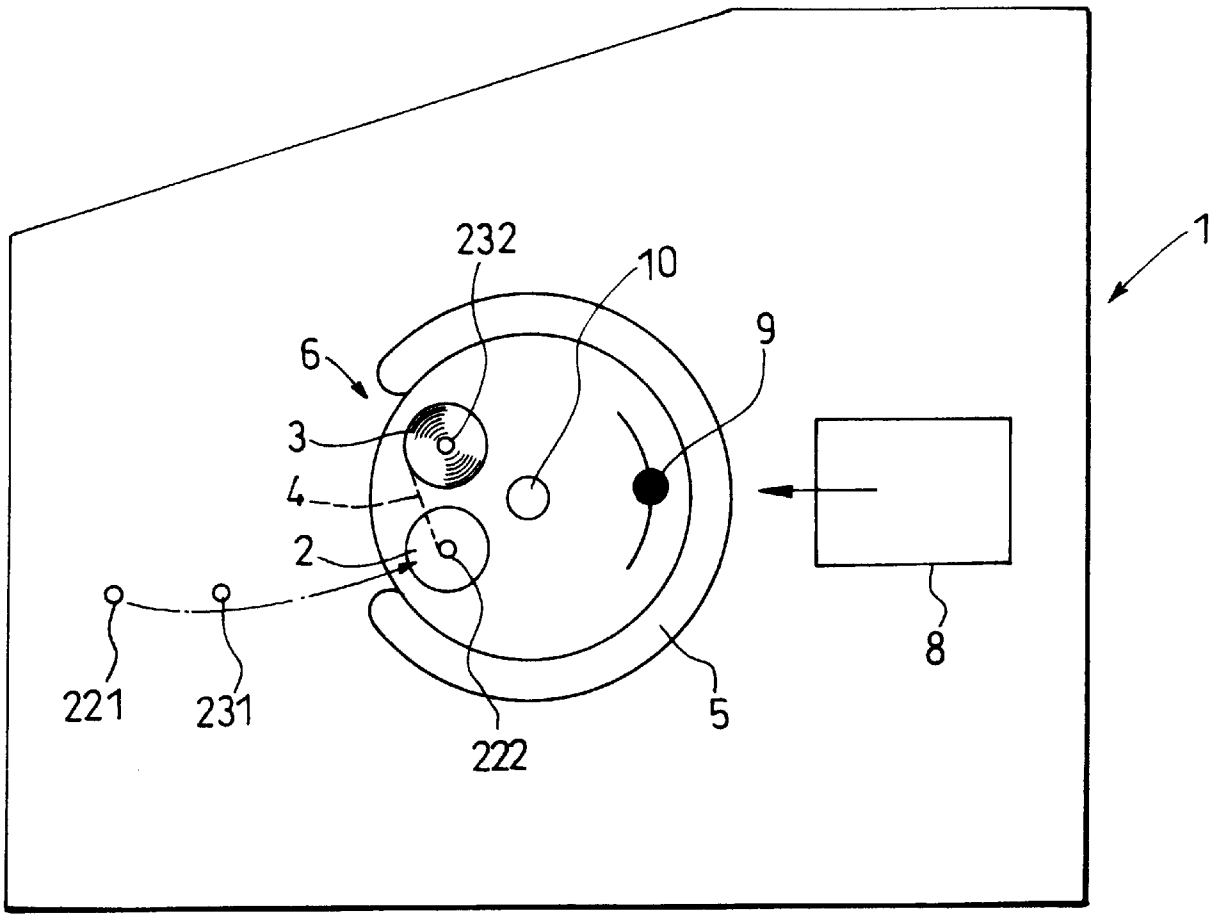
FIG. 4 is a diagram illustrating a third procedure of setting the toner sheet roll shown in FIG. 1.
Figure 5A:
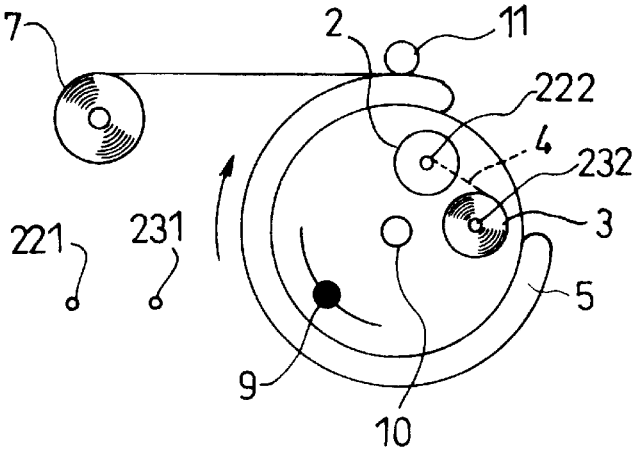
FIGS. 5(*a*) to 5(*e*) are diagrams illustrating the process of winding a recording sheet shown in FIG. 1 around the surface of a hollow drum.
Figure 5B:
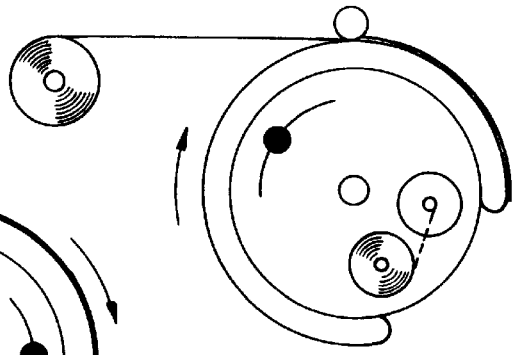
Figure 5C:
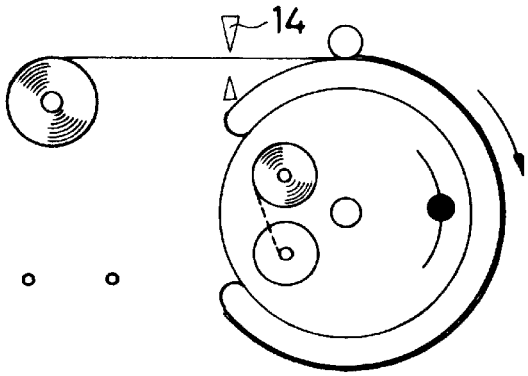
Figure 5D:
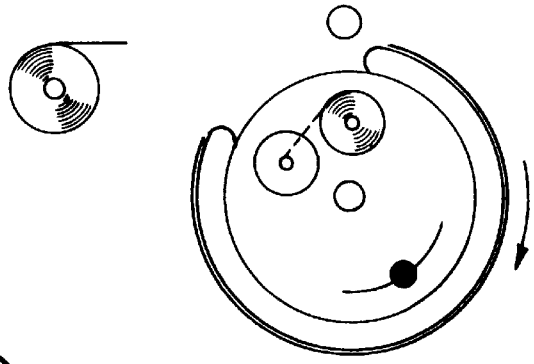
Figure 5E:
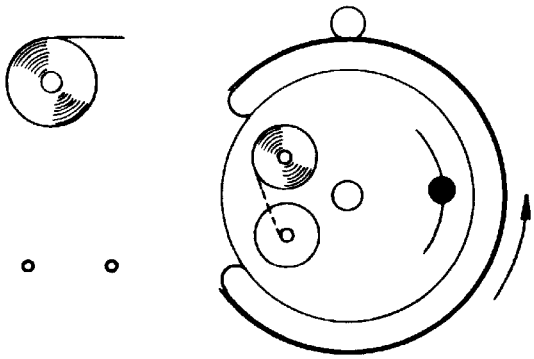
Figure 6A:
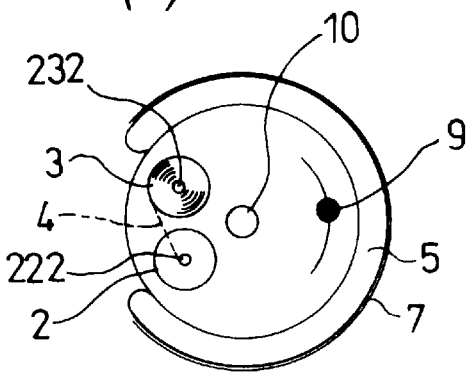
FIGS. 6(*a*) to 6(*h*) are diagrams illustrating the process of winding a toner sheet shown in FIG. 1 around the surface of the hollow drum.
Figure 6B:
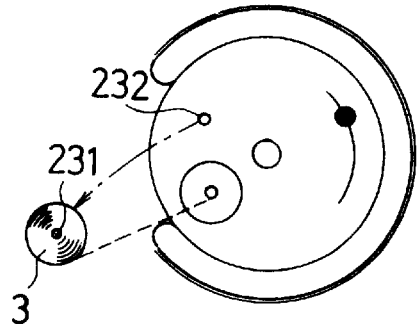
Figure 6C:
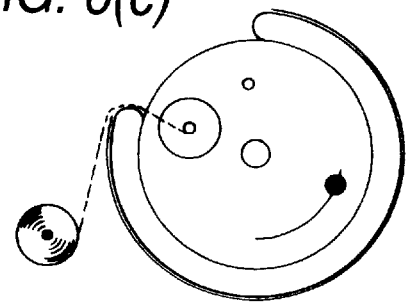
Figure 6D:
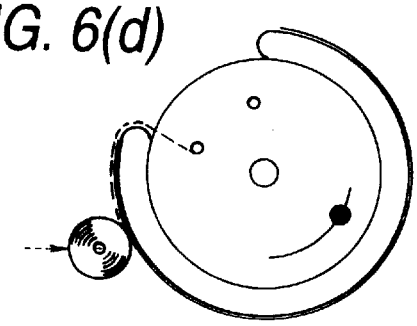
Figure 6E:
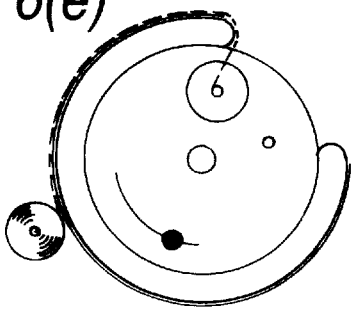
Figure 6E:
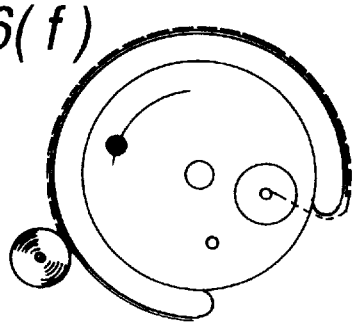
Figure 6G:
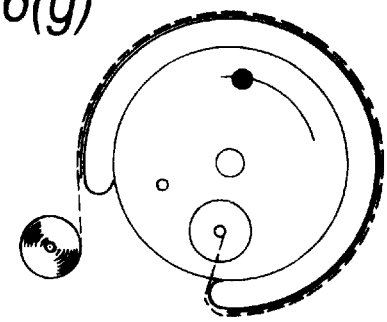
Figure 6H:
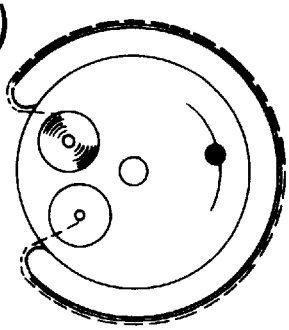
Figure 7A:
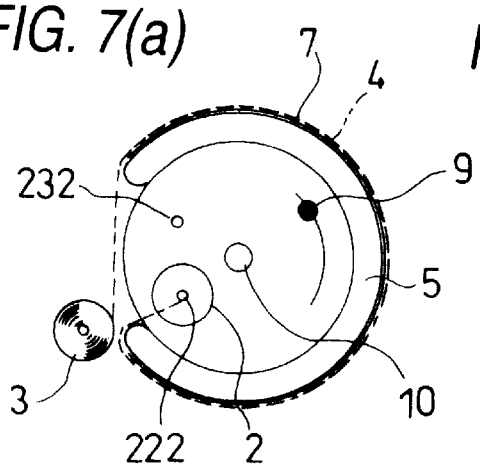
FIGS. 7(*a*) to 7(*g*) are diagrams illustrating the process of releasing the toner sheet shown in FIG. 1 from the surface of the hollow drum.
Figure 7B:
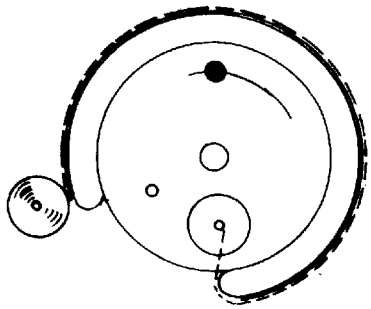
Figure 7C:
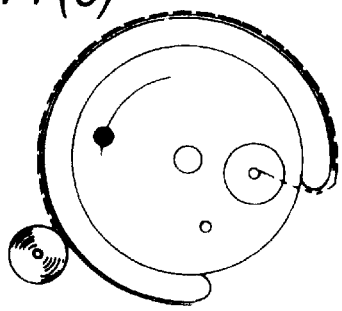
Figure 7D:
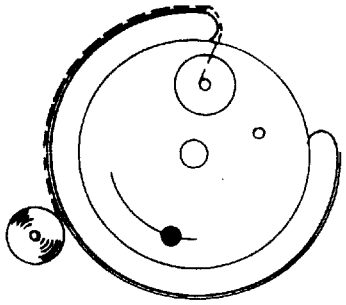
Figure 7E:
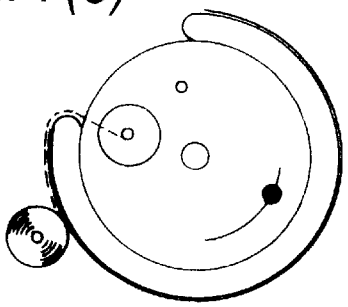
Figure 7E:
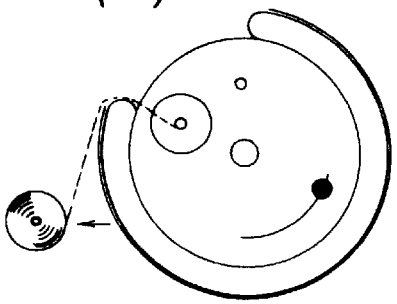
Figure 7G:
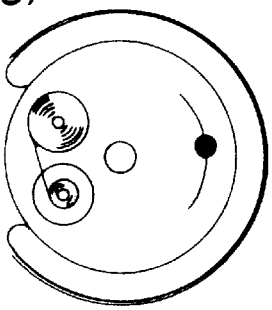
Figure 8A:
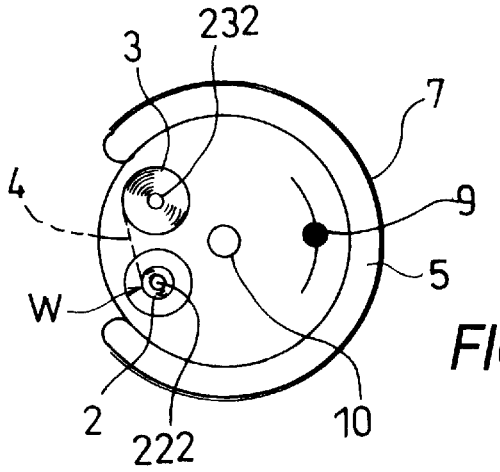
FIGS. 8(*a*) to 8(*e*) are diagrams illustrating the process of winding the toner sheet around the surface of the hollow drum in accordance with a second embodiment of the present invention.
Figure 8B:
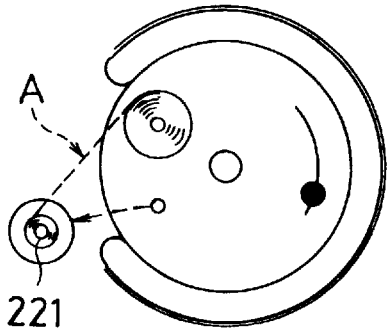
Figure 8C:
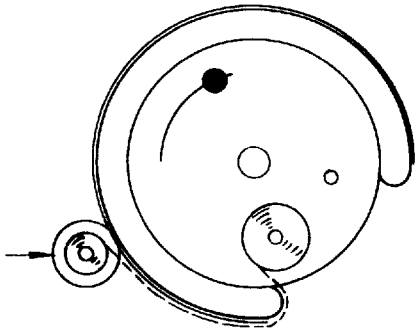
Figure 8D:
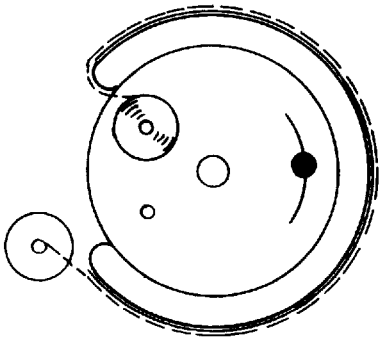
Figure 8E:
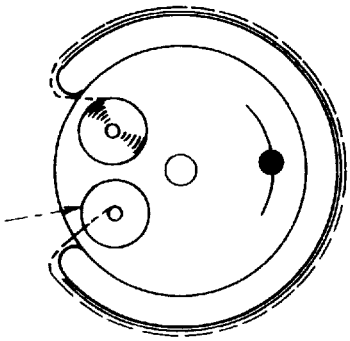

(2) Accordingly, this toner-sheet loading means first sets the feed roll 2 from the external holder 221 to the internal holder 222 inside the hollow drum 5, as shown in FIG. 4.

(3) Subsequently, the toner-sheet loading means sets the take-up roll 2 from the external holder 221 to the internal holder 222 inside the hollow drum 5, as shown in FIG. 4.

In addition, at this time, if the take-up roll 2 or the feed roll 3 is transported while being rotated in the taking-up direction, the toner sheet 4 does not slacken.

(4) Thus, the take-up roll 2 and the feed roll 3, which are the two rolls of the toner sheet 4, are set inside the hollow drum 5, and assume an initial state, as shown in FIG. 1.

FIGS. 5(*a*) to 5(*e*) are diagrams illustrating the process of winding the recording sheet 7, shown in FIG. 1, around the surface of the hollow drum 5. In the drawings, reference numeral 2 denotes the take-up roll; 3, the feed roll; 4, the toner sheet; 5, the circular arc-shaped hollow drum body; 7, the recording sheet; 221, the external holder for the take-up roll; 222, the internal holder for the take-up roll; 231, the external holder for the feed roll; 232, the internal holder for the feed roll; 9, the balancer; and 10, the rotating shaft.

(1) First, as shown in FIG. 5(*a*), the recording sheet 7 in the state shown in FIG. 1 is transported from a recording sheet roll to the hollow drum 5, and the hollow drum 5 is slightly rotated clockwise in the state shown in FIG. 1 and is brought to the position where the recording sheet 7 is wound around the hollow drum 5.

Then, a leading end of the recording sheet 7 is set on the hollow drum 5 such that an image layer surface (the recording surface in the case of the final sheet) is located on the outside (i.e., the side away from the drum), the hollow drum 5 is evacuated by the unillustrated pump, thereby allowing the recording sheet 7 to be sucked onto the hollow drum 5.

At this time, it suffices if a squeegee roller (or a roller also serving as an adhesive roller) 11 is lowered from above to effect a squeegeeing operation or a cleaning operation.

(2) Subsequently, as shown in FIG. 5(*b*), the hollow drum 5 is rotated clockwise through a predetermined angle to wind the recording sheet 7 therearound. At this time as well, the squeegeeing operation or the cleaning operation is effected by the squeegee roller (or the roller also serving as an adhesive roller) 11 from above.

(3) When the size of the recording sheet 7 has reached the size of the image, the rotation of the hollow drum 5 is stopped, and the recording sheet 7 is cut by a cutter 14 (see FIG. 5(*c*)).

(4) All the recording sheet 7 cut to a predetermined size is wound around the hollow drum 5, and is brought into close contact with the hollow drum 5 and is fixed thereon by performing evacuation, as shown in FIG. 5(*d*). Further, the remaining recording sheet 7 which has been cut is taken up onto the recording sheet roll again.

(5) Finally, as shown in FIG. 5(*e*), the hollow drum 5 is rotated to return the rotational position of the hollow drum 5 to the initial state shown in FIG. 1.

It should be noted that, in each of the above-described processes, the take-up roll 2 and the feed roll 3, which are the two rolls of the toner sheet, remain set in the hollow drum 5. In addition, although in the above description the hollow drum 5 is rotated clockwise, this is because the recording sheet 7 is disposed on the left-hand side of the hollow drum 5 in the drawing, and in a case where the recording sheet 7 is disposed on the right-hand side of the hollow drum 5 in the drawing, the hollow drum 5 is rotated counterclockwise.

Next, referring to FIGS. 6(*a*) to 6(*h*), a description will be given of the process in which the toner sheet is wound around the recording sheet 7 thus loaded on the hollow drum 5. In FIG. 6(*a*), reference numeral 2 denotes the take-up roll; 3, the feed roll; 4, the toner sheet; 5, the circular arc-shaped hollow drum body; 7, the recording sheet; 222, the internal holder for the take-up roll; 231, the external holder for the feed roll (see FIG. 6(*b*)); 232, the internal holder for the feed roll; 9, the balancer; and 10, the rotating shaft.

(1) FIG. 6(*a*) shows the initial state of the hollow drum 5 with the recording sheet 7 loaded thereon. Namely, the take-up roll 2 and the feed roll 3, which are the two rolls of the toner sheet, are in the state of being set inside the hollow drum 5.

(2) Next, as shown in FIG. 6(*b*), the unillustrated toner-sheet loading means transfers the feed roll 3 from the internal holder 232 inside the hollow drum to the external holder 231 outside the hollow drum.

(3) Subsequently, as shown in FIG. 6(*c*), the hollow drum 5 is rotated clockwise until it assumes the position at which the toner sheet 4 starts to be wound around the hollow drum 5.

(4) Further, as shown in FIG. 6(*d*), the feed roll 3 is moved (in the direction of arrow) while the toner sheet 4 is being taken up, and is brought into contact with the surface of the hollow drum 5. The feed roll 3 is thus made to perform the squeegeeing operation as well.

(5) As shown in FIG. 6(*e*), while the toner sheet 4 is being fed from the feed roll 3, tension is applied to the toner sheet so that creases will be not occur in it, and squeegeeing is effected. In addition, the rotation of the take-up roll 2 is locked, and winding is started by rotating the hollow drum 5 clockwise.

(6) As shown in FIG. 6(*f*), the hollow drum 5 is further rotated clockwise to continue the winding of the toner sheet.

(7) Finally, the toner sheet is wound up to the end portion of the hollow drum 5 (see FIG. 6(*g*)).

(8) After the toner sheet has been wound up to the end portion of the hollow drum 5, the feed roll 3 is returned to the internal holder 232 in the hollow drum 5, thereby completing the toner-sheet winding process.

Upon completion of the winding of the toner sheet, exposure recording is then effected. The exposure is effected by applying laser light from the optical head 8 toward the hollow drum 5 with the toner sheet 4 and the recording sheet 7 loaded thereon.

In the exposure, in a case where the hollow drum 5 is a high-speed rotating type, the main scanning direction coincides with the rotating direction of the hollow drum 5, while the sub scanning direction coincides with the moving direction of the optical head 8. Meanwhile, in a case where the head is such as a thermal head having a long recording width, recording becomes that of low-speed rotation, and the main scanning direction coincides with the axial direction of the hollow drum, while the sub scanning direction coincides with the rotating direction of the hollow drum.

In addition, the balancer 9 maintains a rotational balance when a predetermined amount of the toner sheet 4 has moved from the feed roll 3 to the take-up roll 2, thereby suppressing vibrations and the like during high-speed rotation. Namely, the balancer 9 automatically assumes the following positions (1) to (3).

(1) When the toner sheet 4 is distributed substantially equally between the feed roll 3 and the take-up roll 2, the balancer 9 is at a central position (e.g., the position of the balancer 9 in FIG. 1).

(2) In addition, when a large amount of the toner sheet 4 is located on the feed roll 3, the balancer 9 automatically moves clockwise in the drawing at a predetermined angle from the aforementioned central position.

(3) Then, when a large amount of the toner sheet 4 is located on the take-up roll 2, the balancer 9 automatically moves counterclockwise in the drawing at a predetermined angle from the aforementioned central position.

Next, referring to FIGS. 7(*a*) to 7(*g*), a description will be given of a releasing process in which the toner sheet 4 after being subjected to exposure recording is released from the hollow drum 5. In the drawings, reference numeral 2 denotes the take-up roll; 3, the feed roll; 4, the toner sheet; 5, the circular arc-shaped hollow drum body; 7, the recording sheet; 222, the internal holder for the take-up roll; 232, the internal holder for the feed roll; 9, the balancer; and 10, the rotating shaft.

(1) As shown in FIG. 7(*a*), in the same way as during winding, the toner-sheet loading means transfers the feed roll 3 from the internal holder 232 inside the hollow drum 5 to outside the hollow drum 5.

(2) As shown in FIG. 7(*b*), the feed roll 3 is brought into contact with the hollow drum 5, and while the toner sheet 4 is taken up by the feed roll 3 to apply tension, the rotation of the take-up roll 2 is locked, and the hollow drum 5 is rotated counterclockwise.

(3) Subsequently, as shown in FIGS. 7(*c*) to 7(*e*), in a state in which the feed roll 3 is brought into contact with the hollow drum 5 while taking up the feed roll 3, the hollow drum 5 is rotated counterclockwise to impart a releasing force, thereby releasing the toner sheet 4.

(4) After the toner sheet 4 has been released up to its final portion, the feed roll 3 is removed from the hollow drum 5, as shown in FIG. 7(*f*).

(5) As shown in FIG. 7(*g*), the hollow drum 5 is rotated to its initial position, the feed roll 3 is returned to the inside of the hollow drum 5, and if the toner sheet wound around the feed roll 3 is taken up onto the take-up roll 2 by the length of a one-color portion, since the toner sheet is a ribbon coated in cross stripes, an ensuing color appears.

Thus, the toner sheet loading and exposure shown in FIGS. 6(*a*) to 6(*h*) and the releasing of the toner sheet shown in FIGS. 7(*a*) to 7(*g*) are repeated on the hollow drum for the plurality of colors, and the recording sheet with an image thereon is discharged as a color print.

Thus, in accordance with this embodiment, since only the movement of the feed roll and the rotation of the hollow drum are involved in the winding operation and the releasing operation, only one mechanism is sufficient, so that a compact and efficient mechanism can be realized.

Next, referring to FIGS. 8(*a*) to 8(*e*) and FIGS. 9(*a*) and 9(*b*), a description will be given of a second embodiment of the present invention. In the drawings, reference numeral 2 denotes the take-up roll; 3, the feed roll; 4, the toner sheet; 5, the circular arc-shaped hollow drum body; 7, the recording sheet; 222, the internal holder for the take-up roll; 232, the internal holder for the feed roll; 9, the balancer; and 10, the rotating shaft.

Although, in the foregoing embodiment, the winding process and the releasing process are effected by transferring the feed roll 3 into and outside the hollow drum, the second embodiment shows that if, in that case, the take-up roll 2 is also provided with a moving mechanism, a mechanism for coming into contact with and pressing the hollow drum 5, and the like, the winding and taking up (releasing process) of the take-up roll 2 are also possible. However, both the feed roll 3 and the take-up roll 2 need to be provided with moving mechanisms and pressing mechanisms.

Accordingly, in the second embodiment, the winding and releasing processes are effected by locking the feed roll 3 and transferring the take-up roll 2 to outside the hollow drum to the contrary, and an example is shown in which the take-up roll 2 is transferred between the internal holder and the external holder in and outside the hollow drum 5.

Accordingly, a description will be given of the toner-sheet winding process in accordance with the second embodiment after the winding of the recording sheet 7 has been completed in the process shown in FIGS. 5(*a*) to 5(*e*).

(1) First, in the initial state in which the take-up roll 2 and the feed roll 3, which are the two rolls of the toner sheet, are set inside the hollow drum 5, the toner sheet of a portion to be recorded is fed out by the length W of a one-color portion, and is taken up onto the take-up roll 2 (see FIG. 8(*a*))

(2) After completion of the taking up of the toner sheet by the length W of the one-color portion onto the take-up roll 2, the take-up roll 2 is transferred to the external holder 221 outside the hollow drum 5 (see FIG. 8(*b*)).

(3) Since the toner layer (A side) is opposite to the case where the feed roll 3 is moved outside the hollow drum, the hollow drum 5 is rotated counterclockwise up to the position for winding the toner sheet. Subsequently, the take-up roll 2 is brought into contact with the surface of the hollow drum 5 while being taken up, and while the toner sheet 4 is being fed out from the take-up roll 2, the feed roll 3 is locked, and the hollow drum 5 is rotated counterclockwise, thereby starting the winding (see FIG. 8(*c*)).

(4) After the toner sheet 4 is wound around the entire hollow drum 5, the rotation of the hollow drum 5 is stopped (see FIG. 8(*d*)).

(5) Subsequently, the take-up roll 2 is returned to the internal holder inside the hollow drum 5 (see FIG. 8(*e*)).

Figure 9A:
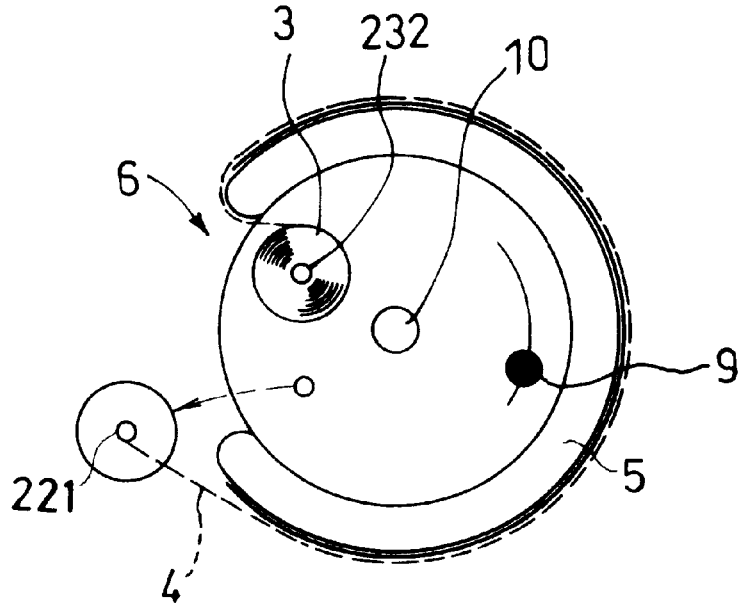
FIGS. 9(*a*) and 9(*b*) are diagrams illustrating the process of releasing the toner sheet shown in FIGS. 8(*a*) to 8(*e*) from the surface of the hollow drum.
Figure 9B:
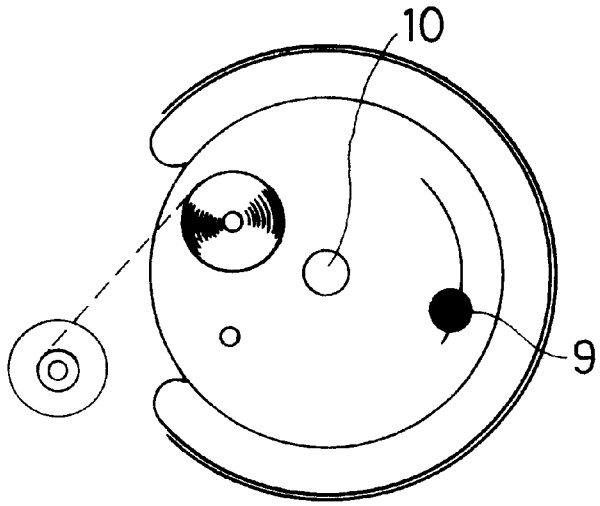

FIGS. 9(*a*) and 9(*b*) are diagrams illustrating the releasing process in which the toner sheet 4 loaded on the hollow drum 5 as shown in FIGS. 8(*a*) to 8(*e*) is released from the hollow drum 5.

(1) First, as shown in FIG. 9(*a*), the take-up roll 2 is transferred to the external holder 221 outside the hollow drum.

(2) While the toner sheet 4 is being taken up onto the take-up roll 2, the rotation of the feed roll 3 is locked, and the hollow drum 5 is rotated clockwise, thereby releasing the toner sheet, as shown in FIG. 9(*b*). The take-up roll 2 is then returned to the internal holder in the same way as in FIG. 7(*g*).

As described above, although the winding and releasing processes are possible even if the take-up roll 2 is transferred to outside the hollow drum, it is sufficiently conceivable that creases have occurred in the toner sheet on the take-up roll 2 unlike with the feed roll 3. In addition, creases are likely to occur at the time when the toner sheet is initially taken up. If the squeegeeing operation or the like is effected in this state, there is a large possibility that image defects occur in the recorded image due to not uniform pressure and the like, so that the type in which the feed roll 3 is moved is stable in implementing the recording apparatus.

Next, referring to FIG. 10, a description will be given of a third embodiment of the present invention.

Figure 10:
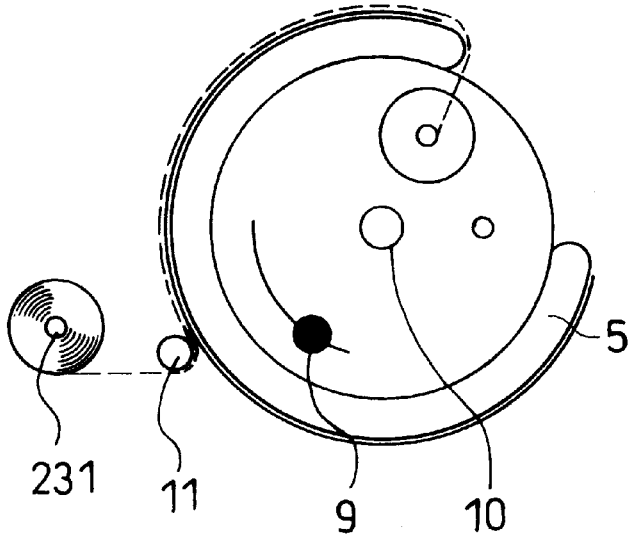
FIG. 10 is an explanatory diagram of a squeegee roller in accordance with a third embodiment of the present invention.

FIG. 10 is an explanatory diagram of a squeegee roller in accordance with the third embodiment of the present invention.

Although, in the first and second embodiments, the squeegeeing (pressing) and releasing operations are respectively effected by the mechanism for bringing the feed roll 3 or the take-up roll 2 into contact with the surface of the hollow drum, in a case where the feed roll 3 is transferred as in FIG. 10, the squeegee roller (also serving as a release roller) 11 may be provided so as to effect the winding and releasing operation stably. As the squeegee roller (release roller) 11, it is preferable to use a roller having, for instance, a crown shape or a zebra pattern for preventing the occurrence of creases.

Next, referring to FIG. 11, a description will be given of a fourth embodiment of the present invention.

Figure 11:
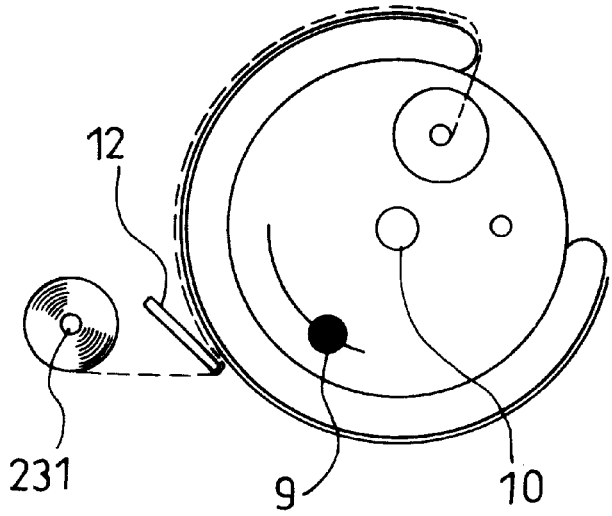
FIG. 11 is an explanatory diagram of a squeegee bar in accordance with a fourth embodiment of the present invention.

FIG. 11 is an explanatory diagram of a squeegee bar in accordance with the fourth embodiment of the present invention.

In this embodiment, a squeegee bar (also serving as a release bar) 12 is provided instead of the squeegee roller 11 shown in FIG. 10, and since the squeegee bar (release bar) 12 is capable of making curvature of the releasing local portion large during releasing, the releasing force becomes large.

Thus, in accordance with the present invention, since the take-up roll and the feed roll of the toner sheet mechanism are accommodated inside the hollow drum, and an efficient mechanism is adopted in which the winding, releasing, and discharging are made possible by the movement of one roll into or out of the hollow drum, it is possible to cope with a printing proofing apparatus, a compact electronic equipment-compatible apparatus, a color facsimile machine, and so on.

What is claimed is:

1. A hollow drum-type recording apparatus comprising:

a hollow drum which has an opening and whose hollow circular arc-shaped main body rotates;

an internal holder for a feed roll and an internal holder for a take-up roll for respectively accommodating and disposing inside said hollow drum a feed roll for feeding a toner sheet and a take-up roll for taking up the toner sheet through said opening; and an external holder for a feed roll and an external holder for a take-up roll for respectively accommodating and disposing outside said hollow drum said feed roll for feeding the toner sheet and said take-up roll for taking up the toner sheet through said opening, wherein a winding, a releasing, and a discharging of the toner sheet are effected by appropriately moving said feed roll and said take-up roll between said internal holders and said external holders and by rotating said hollow drum.

2. The hollow drum-type recording apparatus according to claim 1, further comprising:

toner-sheet loading means for transferring and loading said feed roll and said take-up roll between said internal holders and said external holders.

3. The hollow drum-type recording apparatus according to claim 2, wherein said toner-sheet loading means effects a series of operations of transferring said feed roll from said internal holder to said external holder, bringing said feed roll into contact with said hollow drum at a position for winding the toner sheet, locking a rotation of said take-up roll, winding the toner sheet around a recording sheet on said hollow drum by rotating said hollow drum, and subsequently returning said feed roll back to said internal holder.

4. The hollow drum-type recording apparatus according to claim 3, wherein said toner-sheet loading means effects a series of operations of transferring said feed roll from said internal holder to said external holder, locking the rotation of said take-up roll, releasing the toner sheet by rotating said hollow drum and bringing said feed roll into contact with said hollow drum, and subsequently returning said feed roll back to said internal holder.

5. The hollow drum-type recording apparatus according to claim 2, wherein said toner-sheet loading means effects a series of operations of transferring said take-up roll from said internal holder to said external holder outside said hollow drum, bringing said take-up roll into contact with said hollow drum at a position for winding the toner sheet, locking the rotation of said feed roll, winding the toner sheet around a recording sheet on said hollow drum by rotating said hollow drum, and subsequently returning said take-up roll back to said internal holder.

6. The hollow drum-type recording apparatus according to claim 5, wherein said toner-sheet loading means effects a series of operations of transferring said take-up roll from said internal holder to said external holder, locking the rotation of said feed roll, releasing the toner sheet by rotating said hollow drum and bringing said take-up roll into contact with said hollow drum, and subsequently returning said take-up roll back to said internal holder.

7. The hollow drum-type recording apparatus according to claim 1, wherein said feed roll or said take-up roll is arranged so as to contact and press said hollow drum indirectly, through a squeegeeing/releasing means which is provided to effect pressing and releasing.

8. The hollow drum-type recording apparatus according to claim 7, wherein, said squeegeeing/releasing means is a squeegeeing/releasing roller.

9. The hollow drum-type recording apparatus according to claim 8, wherein said squeegeeing/releasing roller has a crown shape surface.

10. The hollow drum-type recording apparatus according to claim 8, wherein said squeegeeing/releasing roller has a zebra pattern on the surface of the roller.

11. The hollow drum-type recording apparatus according to claim 7, wherein said squeegeeing/releasing means is a squeegeeing/releasing bar.

12. The hollow drum-type recording apparatus according to claim 1, further comprising:

recording-sheet loading means for sucking a leading end of a recording sheet at a position for starting the winding of the recording sheet around said hollow drum, rotating said hollow drum, cutting the recording sheet to a predetermined length, and winding the recording sheet around said hollow drum.

13. The hollow drum-type recording apparatus according to claim 1, wherein a loading means effects winding, releasing, and discharging by transferring the take-up roll between the internal holder and the external holder.

14. The hollow drum-type recording apparatus according to claim 1, wherein exposure recording is effected by an optical head in a state in which a recording sheet and the toner sheet are arranged on a surface of said hollow drum, and both said feed roll and said take-up roll are disposed on said internal holders.

15. The hollow drum-type recording apparatus according to claim 1, further comprising:

an automatic balancer provided in said hollow drum to smoothen the rotation of said hollow drum during recording.

16. The hollow drum-type recording apparatus according to claim 1, wherein said hollow drum has a vacuum means for sucking said recording sheet.

* * * * *